US008063870B2

(12) United States Patent
Cho

(10) Patent No.: US 8,063,870 B2
(45) Date of Patent: Nov. 22, 2011

(54) VIDEO PROCESSING APPARATUS AND VIDEO PROCESSING METHOD

(75) Inventor: Jeong-bae Cho, Suwon-si (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 987 days.

(21) Appl. No.: 11/752,571

(22) Filed: May 23, 2007

(65) Prior Publication Data

US 2008/0030430 A1 Feb. 7, 2008

(30) Foreign Application Priority Data

Aug. 4, 2006 (KR) ..... 10-2006-0073795

(51) Int. Cl.
*G09G 3/36* (2006.01)

(52) U.S. Cl. ..... 345/102; 345/691

(58) Field of Classification Search ..... 345/102, 345/4, 84, 691, 44
See application file for complete search history.

(56) References Cited

U.S. PATENT DOCUMENTS

| | | | | |
|---|---|---|---|---|
| 2003/0174262 | A1 | 9/2003 | Sugawara et al. | |
| 2005/0110740 | A1* | 5/2005 | Linzmeier et al. | 345/102 |
| 2005/0184952 | A1 | 8/2005 | Konno et al. | |
| 2006/0007112 | A1 | 1/2006 | Park | |
| 2006/0125771 | A1* | 6/2006 | Inuzuka et al. | 345/102 |
| 2006/0125775 | A1* | 6/2006 | Itoh | 345/102 |
| 2007/0132706 | A1* | 6/2007 | Nishimura et al. | 345/102 |
| 2008/0150853 | A1* | 6/2008 | Peng et al. | 345/87 |

FOREIGN PATENT DOCUMENTS

| | | | |
|---|---|---|---|
| CN | 1716039 | A | 1/2006 |
| KR | 2000-0009556 | | 2/2000 |
| KR | 2005-0002566 | | 1/2005 |
| KR | 2006-0001694 | | 1/2006 |
| WO | 2004/079437 | A1 | 9/2004 |
| WO | WO 2005/103801 | A1 | 11/2005 |

* cited by examiner

*Primary Examiner* — Amr Awad
*Assistant Examiner* — Andre Matthews
(74) *Attorney, Agent, or Firm* — Jefferson IP Law, LLP

(57) ABSTRACT

A video processing apparatus and method, the apparatus including: a signal processing part to process an inputted video signal; a display panel to display the processed video signal; a backlight unit that comprises a plurality of light emitting elements that correspond to pixels of the processed video signal and emit light to the display panel; and a controller to calculate a brightness of each of the pixels based on R, G and B component values of each of the pixels, and to control the backlight unit such that the plurality of light emitting elements emit light with intensities corresponding to the calculated brightness of each of the pixels. Thus, aspects of the present invention are capable of improving quality of a video and reducing power consumption.

14 Claims, 3 Drawing Sheets

| Bit | | 7 | 6 | 5 | 4 | 3 | 2 | 1 | 0 | | BRIGHTNESS STEP |
|---|---|---|---|---|---|---|---|---|---|---|---|
| (A) | R | 1 | 1 | 0 | 1 | 0 | 0 | 0 | 1 | | |
| | G | 1 | 0 | 1 | 0 | 1 | 1 | 1 | 0 | → | 4 |
| | B | 0 | 1 | 1 | 0 | 0 | 1 | 0 | 0 | | |
| (B) | R | 0 | 0 | 1 | 1 | 0 | 1 | 1 | 0 | | |
| | G | 0 | 0 | 0 | 1 | 1 | 1 | 0 | 1 | → | 3 |
| | B | 0 | 0 | 1 | 0 | 1 | 1 | 0 | 0 | | |
| (C) | R | 0 | 0 | 0 | 0 | 0 | 1 | 0 | 0 | | |
| | G | 0 | 0 | 0 | 0 | 1 | 1 | 0 | 1 | → | 2 |
| | B | 0 | 0 | 0 | 0 | 1 | 0 | 1 | 0 | | |

FIG. 2

| Bit | | 7 | 6 | 5 | 4 | 3 | 2 | 1 | 0 | | BRIGHTNESS STEP |
|---|---|---|---|---|---|---|---|---|---|---|---|
| (A) | R | 1 | 1 | 0 | 1 | 0 | 0 | 0 | 1 | → | 4 |
| | G | 1 | 0 | 1 | 0 | 1 | 1 | 1 | 0 | | |
| | B | 0 | 1 | 1 | 0 | 0 | 1 | 0 | 0 | | |
| (B) | R | 0 | 0 | 1 | 1 | 0 | 1 | 1 | 0 | → | 3 |
| | G | 0 | 0 | 0 | 1 | 1 | 1 | 0 | 1 | | |
| | B | 0 | 0 | 1 | 0 | 1 | 1 | 0 | 0 | | |
| (C) | R | 0 | 0 | 0 | 0 | 0 | 1 | 0 | 0 | → | 2 |
| | G | 0 | 0 | 0 | 0 | 1 | 1 | 0 | 1 | | |
| | B | 0 | 0 | 0 | 0 | 1 | 0 | 1 | 0 | | |

VIDEO PROCESSING APPARATUS AND VIDEO PROCESSING METHOD

CROSS-REFERENCE TO RELATED APPLICATION

This application claims the benefit of Korean Patent Application No.2006-73795, filed on Aug. 4, 2006 in the Korean Intellectual Property Office, the disclosure of which is incorporated herein by reference.

BACKGROUND OF THE INVENTION

1. Field of the Invention

Aspects of the present invention relate to a video processing apparatus and method, an intensity of light emitted from a backlight unit and, hence, brightness of a display panel.

2. Description of the Related Art

Among video processing apparatuses, a liquid crystal display (LCD) has an LCD panel that does not emit light by itself, unlike a plasma display panel (PDP), and is adjusted in brightness by controlling the intensity of white light emitted from light emitting elements (such as a light emitting diode (LED), an organic light emitting diode (OLED), or the like) of a backlight.

In such a conventional LCD, methods of adjusting the brightness of the LCD panel by controlling the intensity of white light emitted from the LED or the OLED include adjusting the LCD panel by emitting light from the backlight according to brightness information inputted by a user and adjusting the LCD panel by emitting light from the backlight according to power inputted to the LCD. The method of adjusting the LCD panel according to the inputted power includes maintaining a maximum brightness of the LCD panel if the input power is AC power, and decreasing the brightness of the LCD panel in proportion to time during which there is no input from a user if the inputted power is DC power, such as battery power.

However, these conventional methods of adjusting the brightness of the LCD panel have a difficulty in displaying a video clearly since the brightness of the LCD panel is adjusted irrespective of an inputted video signal, and a disadvantage in that power consumption is great, compared to adjustment of brightness for each pixel of a video, since the brightness of the LCD panel is collectively adjusted.

SUMMARY OF THE INVENTION

Accordingly, aspects of the present invention provide a video processing apparatus and method which is capable of improving quality of a video and reducing power consumption by calculating the intensity of light emitted from light emitting elements of a backlight based on brightness information of an inputted video signal.

According to an aspect of the present invention, there is provided a video processing apparatus comprising: a signal processing part to process an inputted video signal; a display panel to display the processed video signal; a backlight unit that comprises a plurality of light emitting elements that correspond to pixels of the processed video signal and emit light to the display panel; and a controller to calculate brightness of each of the pixels based on R, G and B component values of each of the pixels of the video signal processed by the signal processing part, and to control the backlight unit such that the plurality of light emitting elements emit light with intensity corresponding to the calculated brightness of each of the pixels.

The controller may calculate the brightness of each of the pixels by performing an OR operation for the R, G and B component values of each of the pixels.

The video processing apparatus may further comprise a storage part, wherein the controller stores information on the calculated brightness of each of the pixels and information on an intensity of light corresponding to the calculated brightness of each of the pixels in the storage part, and controls the backlight unit to emit light with the intensity of light stored in the storage part when the video signal is inputted to the video processing apparatus.

The video processing apparatus further comprise a detecting part to detect the brightness of light emitted from the backlight unit, wherein the controller periodically calculates an average of the brightness of light detected by the detecting part, calculates the brightness of each of the pixels based on R, G and B component values of each of the pixels if the calculated average exceeds a predetermined value, and controls the detecting part and the backlight unit such that the plurality of light emitting elements emits light with the intensity of light corresponding to the calculated brightness of each of the pixels.

The video signal inputted to the signal processing part may be inputted through a low voltage differential signaling (LVDS) interface.

The plurality of light emitting elements provided in the backlight unit may comprise at least one light emitting diode.

According to another aspect of the present invention, there is provided a video processing method of a video processing apparatus comprising a backlight unit including a plurality of light emitting elements, the method comprising: receiving a video signal; calculating brightness of each pixel of the received video signal based on R, G and B component values of each of the pixels; and emitting light with intensities corresponding to the calculated brightness of each of the pixels from the plurality of light emitting elements The calculating of the brightness of each of the pixels of the received video signal may comprise calculating the brightness of each of the pixels by performing an OR operation for the R, G and B component values of each of the pixels.

The calculating of the brightness of each of the pixels of the received video signal may further comprise detecting the brightness of light emitted from the plurality of light emitting elements, and the emitting of the light with the intensity of light corresponding to the calculated brightness of each pixel may comprise calculating an average of the detected brightness of light and if the calculated average exceeds a predetermined value, emitting the light with the intensity of light corresponding to the calculated brightness of each of the pixels from the plurality of light emitting elements.

The video signal may be inputted through a low voltage differential signaling (LVDS) interface.

The plurality of light emitting elements provided in the backlight unit may comprise at least one light emitting diode.

Additional aspects and/or advantages of the invention will be set forth in part in the description which follows and, in part, will be obvious from the description, or may be learned by practice of the invention.

BRIEF DESCRIPTION OF THE DRAWINGS

These and/or other aspects and advantages of the invention will become apparent and more readily appreciated from the following description of the embodiments, taken in conjunction with the accompanying drawings of which:

FIG. 2 is a view illustrating a process of calculating brightness of a backlight in the video processing apparatus according to an embodiment of the present invention.

DETAILED DESCRIPTION OF THE EMBODIMENTS

Figure 1:
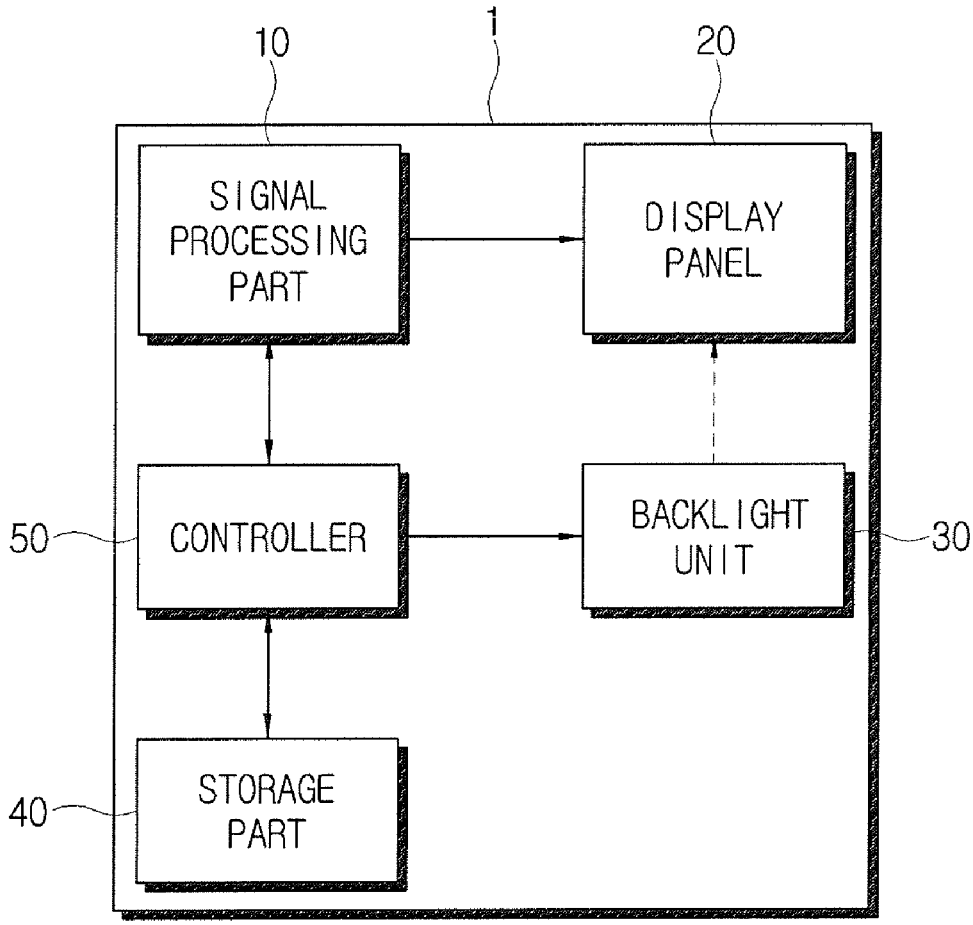
FIG. 1 is a block diagram illustrating a video processing apparatus according to an embodiment of the present invention.

Reference will now be made in detail to present embodiments of the present invention, examples of which are illustrated in the accompanying drawings, , wherein like reference numerals refer to the like elements throughout. The embodiments are described below in order to explain the present invention by referring to the figures.

FIG. 1 is a block diagram illustrating a video processing apparatus according to an embodiment of the present invention. As shown in FIG. 1, a video processing apparatus 1 includes a signal processing part 10, a display panel 20, a backlight unit 30, a storage part 40, and a controller 50. According to an aspect, the video processing apparatus 1 may include an LCD TV, an LCD monitor, etc., including an LCD panel.

The signal processing part 10 receives a video signal and separates the received video signal into an RGB signal and horizontal/vertical synchronization signals to further process. The RGB signal and horizontal/vertical synchronization signals processed by the signal processing part 10 are outputted to the display panel 20 and the controller 40.

According to an aspect, the video signal received and processed by the signal processing part 10 may, although not necessarily, be a signal inputted through a low voltage differential signaling (LVDS) interface. An LVDS signal has a low voltage of 0.9 to 1.4 V and has high data stability and good electromagnetic interference characteristics. The signal processing part 10 may be embodied by a driving circuit such as a timing controller, although not limited thereto.

The display panel 20 displays a video based on the RGB signal and horizontal/vertical synchronization signals processed by the signal processing part 10. The display panel 20 includes a first substrate on which switching elements and pixel electrodes are formed, a second substrate on which R (red), G (green) and B (blue) color filters are formed, and a liquid crystal layer interposed between both substrates. When an electrical signal is applied to liquid crystals in the liquid crystal layer, light emitted from the backlight unit 30 passes through the liquid crystal layer or is blocked by the liquid crystal layer, and/or the amount of light transmitted through the liquid crystal layer is adjusted for display of a video.

The backlight unit 30 is provided with a plurality of light emitting elements corresponding to pixels of the video signal to radiate the display panel 20. Since the display panel 20 does not emit light by itself, the brightness of the video signal outputted to the display panel 20 is adjusted depending on the intensity of light emitted from the light emitting elements provided in the backlight unit 30.

The storage part 40 may, although not necessarily, store information on the brightness of the video signal calculated by the controller 50 and information on an intensity of light corresponding to the brightness of the video signal under control of the controller 50.

The controller 50 checks whether the information on the brightness of each pixel of the inputted video signal is stored in the storage part 40. If the information on the brightness of each pixel is stored in the storage part 40, the controller 50 reads the information on the intensity of light corresponding to the brightness of each pixel from the storage part 40 and outputs the read information to the backlight unit 30. The backlight unit 30 is driven based on this stored intensity of light information without recalculating the intensity of light. It is understood that, according to an aspect, the storage part 10 may be embodied by an HDD or a nonvolatile memory, such as a flash memory, or the like.

The controller 50 calculates the brightness of each pixel of the video signal processed by the signal processing part 10 and controls the backlight unit 30 such that the plurality of light emitting elements emits light with the intensity of light corresponding to the calculated brightness of each pixel. Also, the controller 50 may calculate RGB values of the video signal processed by the signal processing part 10 and adjust the intensity of light emitted from the light emitting elements provided in the backlight unit 30 based on the calculated RGB values.

The video processing apparatus 1 may, although not necessarily, further include a detecting part (not shown) to detect the brightness of light emitted from the backlight unit 30. The detecting part may include an optical sensor or the like that senses light. In this case, the detecting part may further include a photoelectric converter that converts the brightness of light detected by the optical sensor into an electric signal.

Then, the controller 50 periodically calculates an average of the brightness of light detected by the detecting part, calculates the brightness of each pixel based on a component value of each pixel if the calculated average exceeds a predetermined value, and controls the detecting part and the backlight unit 30 such that the plurality of light emitting elements emits light with the intensity of light corresponding to the calculated brightness of each pixel. Thus, power consumption can be reduced by adjusting the intensity of light emitted from the backlight unit 30 to be less than a predetermined value.

Hereinafter, a process of the controller 50 to calculate the brightness of the video signal and adjust the intensity of light emitted from the light emitting elements provided in the backlight unit 30 based on the calculated brightness will be described with reference to FIG. 2.

(A), (B) and (C) of FIG. 2 represent RGB values of each pixel of the video signal as binary numbers. FIG. 2 illustrates 256 ($2^8$) gray scales, i.e., gray scales of 8 bits, which can be expressed by each pixel of the video signal. The brightness of each of the pixels is calculated by performing an OR operation for the R, G, and B values of each of the pixels. A case where the intensity of light emitted from the light emitting elements provided in the backlight unit 30 is adjusted in four steps will be described by way of an example.

As shown in (A) of FIG. 2, R, G, and B values of a pixel of the video signal are 11010001, 10101110 and 01100100, respectively. Since "1" is included in two most significant bits of the R, G and B values of the video signal, the controller 50 controls the backlight unit 30 such that the light emitting elements of the backlight unit 30 emit light with intensity in a 4th step, which results in the brightest pixel (step of the intensity of light is 4).

As shown in (B) of FIG. 2, R, G, and B values of a pixel of the video signal are 00110110, 00011101 and 00101100, respectively. Since "1" is included in two second upper significant bits of the R, B and G values of the video signal, the controller 50 controls the backlight unit 30 such that the light emitting elements of the backlight unit 30 emit light with intensity in a 3rd step (step of the intensity of light is 3).

As shown in (C) of FIG. 2, R, G, and B values of a pixel of the video signal are 00000100, 00001101 and 00001010, respectively. Since "1" is included in two third upper significant bits of the R, B and G values of the video signal, the controller 50 controls the backlight unit 30 such that the light emitting elements of the backlight unit 30 emit light with intensity in a 2nd step (step of the intensity of light is 2).

Thus, the controller 50 can adjust the brightness of each pixel of the video signal by adjusting the intensity of light emitted from the light emitting elements provided in the backlight unit 30 based on the calculated brightness of the video signal.

However, it is understood that the intensity of light emitted from the light emitting elements of the backlight unit 30 may be adjusted in finer steps, for example, eight steps instead of the four steps. If the intensity of light is adjusted in eight steps, the intensity of light may be calculated corresponding to respective bits of the R, G and B values of each pixel of the video signal. Specifically, if "1" is included in the most significant bits of binary numbers of the R, G and B values of each pixel, the intensity of light may be adjusted in a 8th step. If "1" is included in second upper significant bits, not in the most significant bits, the intensity of light may be adjusted in a 7th step. As a result, with an increase of the number of steps to adjust the intensity of light, it is possible to display a video more clearly.

Figure 3:
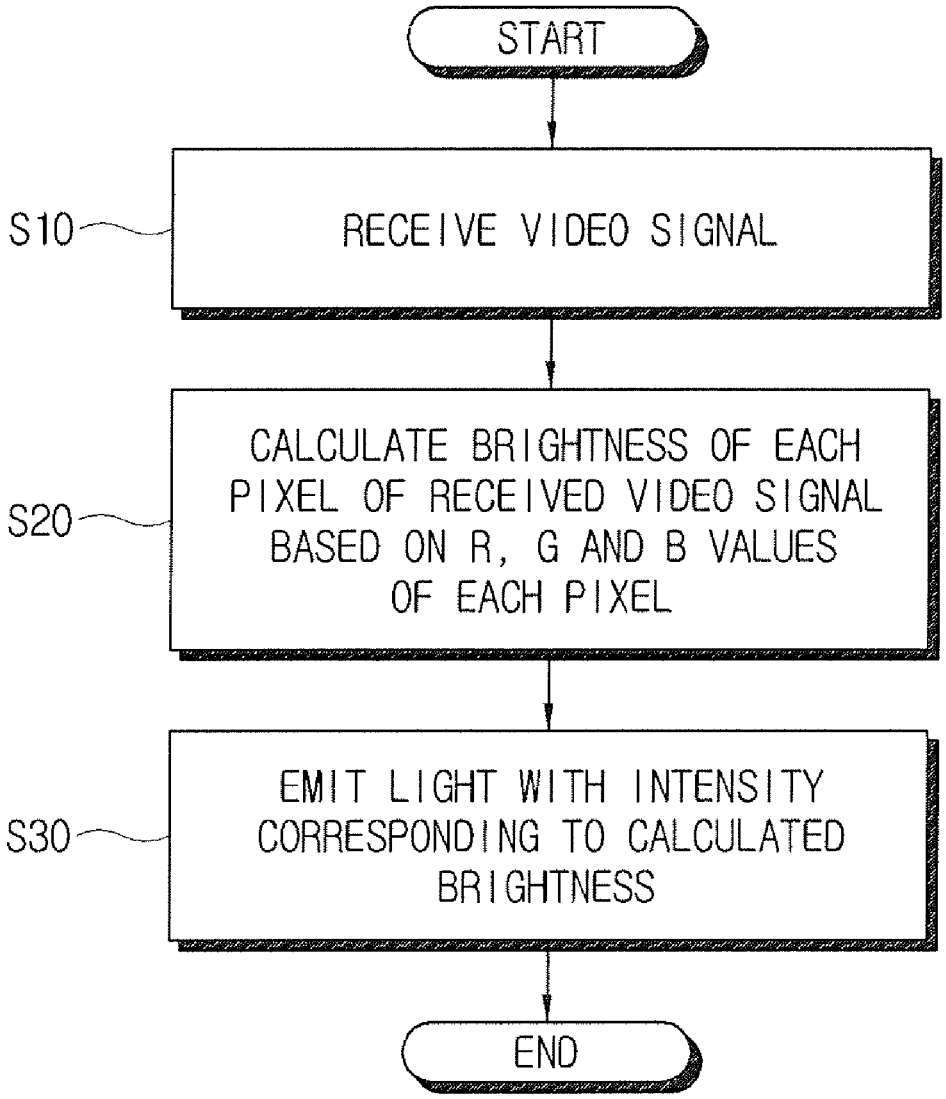
FIG. 3 is a flow chart of a video processing method according to an embodiment of the present invention.

Hereinafter, a video processing method according to an embodiment of the present invention will be described with reference to FIG. 3. First, the signal processing part 10 receives a video signal at operation S10. Next, the controller 50 calculates a brightness of each pixel of the video signal inputted in the operation S10 based on component values of R, G and B values of each pixel at operation S20. Finally, the controller 50 controls the backlight unit 30 such that the plurality of light emitting elements provided in the backlight unit 30 emit light with an intensity corresponding to the brightness of each pixel calculated in the operation S20 to the display panel 20 at operation S30.

According to an aspect, the controller 50 may calculate the intensity of light from the brightness of each pixel by performing an OR logic for the R, G and B component values of each pixel, as illustrated in FIG. 2.

In addition, the operation S20 may further comprise an operation of detecting the brightness of light emitted from the plurality of light emitting elements, and the operation S30 may further comprise an operation of calculating an average of the detected brightness of light. Accordingly, if the average of the detected brightness of light exceeds a predetermined value, the controller 50 calculates the brightness of light for each pixel of the video signal and controls the backlight unit 30 so that the plurality of light emitting elements emit light, thereby reducing power consumption.

As is apparent from the above description, aspects of the present invention provide a video processing apparatus and method that is capable of improving quality of a video and reducing power consumption by calculating the intensity of light emitted from light emitting elements of a backlight based on brightness of an inputted video signal and controlling brightness of the video based on the calculated intensity of light.

Although a few embodiments of the present invention have been shown and described, it will be appreciated by those skilled in the art that changes may be made in this embodiment without departing from the principles and spirit of the invention, the scope of which is defined in the appended claims and their equivalents.

What is claimed is:

1. A video processing apparatus comprising:

a signal processing part for processing an input video signal;

a display panel for displaying the video signal processed by the signal processing part;

a backlight unit comprising a plurality of light emitting elements that correspond to pixels of the processed video signal and emit light to the display panel;

a controller for calculating a brightness of each of the pixels based on R, G, and B component values of each of the pixels of the video signal processed by the signal processing part, and for controlling the backlight unit such that the plurality of light emitting elements emit light with intensities corresponding to the calculated brightness of each of the pixels; and a detecting part for detecting brightness of the light emitted from the backlight unit, wherein the controller periodically calculates an average of the brightness of the light detected by the detecting part such that when the average exceeds a predetermined value, calculates the brightness of each of the pixels, and controls the detecting part and the backlight unit such that the plurality of the light emitting elements emits the light with the intensities corresponding to the calculated brightness of each of the pixels, wherein the R, G, and B component values of each of the pixels are binary numbers, and the controller calculates the brightness of each of the pixels by performing an OR operation for the R, G, and B component values of each of the pixels such that the intensities correspond to a most significant 1 bit or bits of the R, G, and B component values and the intensities are adjusted in eight steps or four steps.

2. The video processing apparatus as claimed in claim 1, further comprising:

a storage part for storing the calculated brightness of each of the pixels, wherein the controller controls the backlight unit to emit the light with the intensities corresponding to the stored brightness of each of the pixels when the video signal is input to the video processing apparatus.

3. The video processing apparatus as claimed in claim 2, wherein the storage part stores information on the intensities of the light corresponding to the calculated brightness of each of the pixels.

4. The video processing apparatus as claimed in claim 1, wherein the video signal input to the signal processing part is input through a low voltage differential signaling (LVDS) interface.

5. The video processing apparatus as claimed in claim 1, wherein the video signal input to the signal processing part is input through a low voltage differential signaling (LVDS) interface.

6. The video processing apparatus as claimed in claim 1, wherein the plurality of light emitting elements comprises at least one light emitting diode.

7. The video processing apparatus as claimed in claim 1, wherein the plurality of light emitting elements comprises at least one light emitting diode.

8. A video processing method of a video processing apparatus comprising a backlight unit including a plurality of light emitting elements, the method comprising:

receiving a video signal;

calculating a brightness of each pixel of the received video signal based on R, G, and B component values of each pixel; and emitting light from the plurality of light emitting elements with intensities corresponding to the calculated brightness of each of the pixels, wherein, the calculating of the brightness of each of the pixels of the received video signal comprises detecting the brightness of the light emitted from the plurality of light emitting elements, and further wherein, the emitting of the light comprises:

calculating an average of the detected brightness of the light; and emitting the light from the plurality of light emitting elements with the intensities corresponding to the calculated brightness of each of the pixels when the calculated average exceeds a predetermined value, wherein the R, G, and B component values of each of the pixels are binary numbers, and the calculating of the brightness of each of the pixels comprises performing an OR operation for the R G and B component values of the pixels such that the intensities correspond to a most significant 1 bit or bits of the R, G, and B component values, and the intensities are adjusted in eight steps or four steps.

9. The video processing method as claimed in claim 8, further comprising:

storing the calculated brightness of each of the pixels.

10. The video processing method as claimed in claim 9, wherein the storing of the calculated brightness further comprises:

storing information on the intensities of the light corresponding to the calculated brightness of each of the pixels.

11. processing method as claimed in claim 8, wherein the video signal is input through a low voltage differential signaling (LVDS) interface.

12. The video processing method as claimed in claim 8, wherein the video signal is input through a low voltage differential signaling (LVDS) interface.

13. The video processing method as claimed in claim 8, wherein the plurality of light emitting elements comprises at least one light emitting diode.

14. The video processing method as claimed in claim 8, wherein the plurality of light emitting elements comprises at least one light emitting diode.

* * * * *